US005779456A

United States Patent [19]

Bowes et al.

[11] Patent Number: 5,779,456

[45] Date of Patent: Jul. 14, 1998

[54] MAGNETIC DRIVE

[75] Inventors: H. David Bowes, Erie, Pa.; Jeffrey S. Richmond, Northbrook, Ill.

[73] Assignee: Finish Thompson Inc., Erie, Pa.

[21] Appl. No.: 738,820

[22] Filed: Oct. 28, 1996

[51] Int. Cl.[6] ..... F04B 17/00

[52] U.S. Cl. ..... 417/420; 417/53

[58] Field of Search ..... 417/420, 423.12, 417/53; 416/3

[56] References Cited

U.S. PATENT DOCUMENTS

| | | | |
|---|---|---|---|
| 1,385,400 | 7/1921 | Scheibe . | |
| 3,429,137 | 2/1969 | Law | 417/420 |
| 3,826,938 | 7/1974 | Filer | 417/420 |
| 4,036,565 | 7/1977 | Becker | 417/420 |
| 4,065,234 | 12/1977 | Yoshiyuki et al. | 417/420 |
| 4,106,825 | 8/1978 | Ruyak | 308/139 |
| 4,115,040 | 9/1978 | Knorr | 417/420 |
| 4,645,433 | 2/1987 | Hauenstein | 417/420 |
| 4,834,628 | 5/1989 | Laing | 417/420 |
| 5,017,102 | 5/1991 | Shimaguchi et al. | 417/420 |
| 5,160,246 | 11/1992 | Horiuchi | 417/365 |
| 5,201,642 | 4/1993 | Hinckley | 417/420 |
| 5,248,245 | 9/1993 | Behnke et al. | 417/420 |
| 5,300,849 | 4/1994 | Elsässer | 310/90.5 |
| 5,464,333 | 11/1995 | Okada et al. | 417/420 |

*Primary Examiner*—Charles G. Freay
*Attorney, Agent, or Firm*—Webb Ziesenheim Bruening Logsdon Orkin & Hanson, P.C.

[57] ABSTRACT

A magnetic drive comprises a plurality of identically shaped and sized permanent magnets for transmitting torque to a shaft through a nonmagnetic cylindrical barrier wherein the magnets have inner and outer cylindrical surfaces with the outer cylindrical surfaces having a radius substantially the same as the inner cylindrical surfaces.

8 Claims, 4 Drawing Sheets

MAGNETIC DRIVE

BACKGROUND OF THE INVENTION

This invention relates to an improved magnetic drive for use in transfer of torque to corrosive or pressurized environments. Magnetic drives are known for transferring torque through nonmagnetic barriers, especially for pumping or stirring liquids on the interior of a sealed enclosure.

Most commercial pump suppliers are required to offer a line of products to customers having a range of maximum torque transfer capability. In the past, this has meant that the overall size of the products had to be increased as the maximum torque transfer capability was increased, resulting in a different set of parts for each product or pump in the line of products. Thus, manufacturers of magnetically driven pumps have found it necessary to purchase or manufacture magnets of many sizes. Typically, the magnets must have increased axial length as the need for increased torque was required. Also, the driving magnets and the driven magnets for each size pump had different shapes or configurations.

This patent application is based upon a unique application of the more powerful permanent magnets that have become available in the last several years. The strength of permanent magnets (as measured by energy products $(BH)_{max}$) has rapidly increased in recent years. Approximate strengths for each type of permanent magnet is set forth in the following table.

| MATERIAL | ENERGY PRODUCT $(BH)_{max}$ MGOe(kJ/m$^3$) |
|---|---|
| Ceramic (Ferrite) | 4 (32) |
| Alnico | 12 (95) |
| Samarium Cobalt ($SmCo_5$) | 18 (143) |
| Samarium Cobalt ($Sm_2Co_{17}$) | 27 (215) |
| Neodymium Iron Boron (Nd—Fe—B) | 35 (280) |

In this patent application, we will refer to the samarium cobalt (either) and the neodymium iron boron magnets as rare earth magnets. The rare earth magnets offer the possibility of a radical new approach to design of magnetic couplings that transfer torque. Unless high temperatures are likely, the neodymium iron boron magnets are the preferred rare earth magnets for the practice of this invention.

It is an advantage, according to this invention, to construct a magnetic drive with magnets of the rare earth type having a single size and shape used on both the driving and driven magnet assemblies.

It is a further advantage of this invention to construct a series of magnetic drives having different maximum torque carrying capacities using magnets of the rare earth type having a single size and shape in both the driving and driven magnet assemblies of all magnetic drives in the series.

It is yet a further advantage, according to this invention, that the need for thrust bearings can be eliminated in the magnetic drives in many applications.

It is a further advantage, according to this invention, to provide a magnetically driven pump or series of magnetically driven pumps wherein the magnets have a single size and shape on both the driving and driven magnet assemblies for all pumps in the series.

SUMMARY OF THE INVENTION

Briefly, according to this invention, there is provided a magnetic drive comprising a plurality of identically shaped and sized permanent magnets for transmitting torque to a shaft through a nonmagnetic cylindrical barrier. The magnetic drive comprises a first assembly positioned to rotate outwardly of the cylindrical barrier, said assembly having a ferromagnetic outer ring with an inner radius RI. The magnetic drive further comprises a second assembly positioned to rotate inwardly of the cylindrical barrier having a ferromagnetic inner ring with an outer radius RO. The first and second assemblies have an identical number of circumferentially spaced permanent magnets spaced around the rings. The magnets have an inner and outer cylindrical surface. The outer cylindrical surface has a radius substantially the same as the inner radius RI of the outer ring and the inner cylindrical surface has a radius substantially the same as the outer radius RO of the inner ring. Preferably, the axial dimension of the cylindrical faces of the magnets and the circumferential dimension are substantially equal. Preferably, the magnets are radially magnetized and an even number of magnets are spaced about each ring with alternating polarities. Preferably, the magnets are of the rare earth type and particularly are of the samarium cobalt or the neodymium iron boron type.

In a preferred embodiment, a magnetically driven pump is provided which comprises an impeller chamber and an impeller positioned to rotate in the chamber mounted on a shaft. The magnetic drive comprises a first ferromagnetic ring positioned to rotate outwardly of a cylindrical barrier and a second ferromagnetic ring positioned to rotate inwardly of the cylindrical barrier. The second ring is connected to the impeller. The first and second rings can be transposed and still achieve the same function. The first and second rings have an even number of circumferentially positioned permanent magnets as above described.

There is also provided, according to this invention, a method of making a series of magnetic drives with different maximum torque capacities from parts having identical dimensions. The method comprises assembling a plurality of identically shaped permanent magnets, a nonmagnetic cylindrical barrier, an outer ring positioned to rotate outwardly of the cylindrical barrier and an inner ring positioned to rotate inwardly of the cylindrical barrier. The identically sized and shaped magnets are circumferentially spaced about the first and second rings in pairs with opposite magnetic polarity. The only difference between magnetic drives of different maximum torque capacity is the number of pairs of permanent magnets spaced around the inner and outer rings.

BRIEF DESCRIPTION OF THE DRAWINGS

Further features and other objects and advantages will become clear from the following detailed description made with reference to the drawings.

DESCRIPTION OF THE PREFERRED EMBODIMENTS

Figure 1:
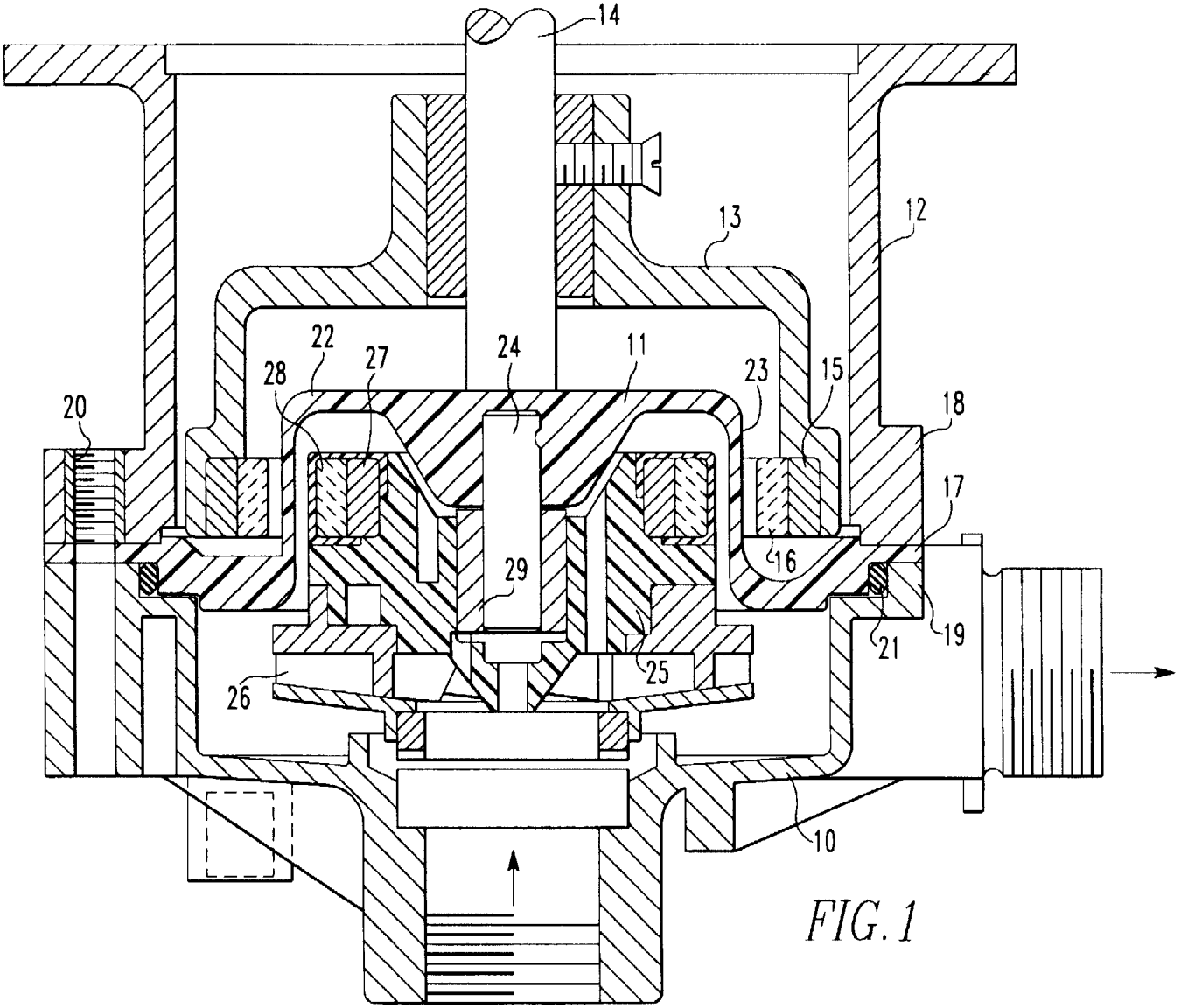
FIG. 1 is a section through a magnetically driven pump incorporating a magnetic drive according to this invention.
Figure 5:
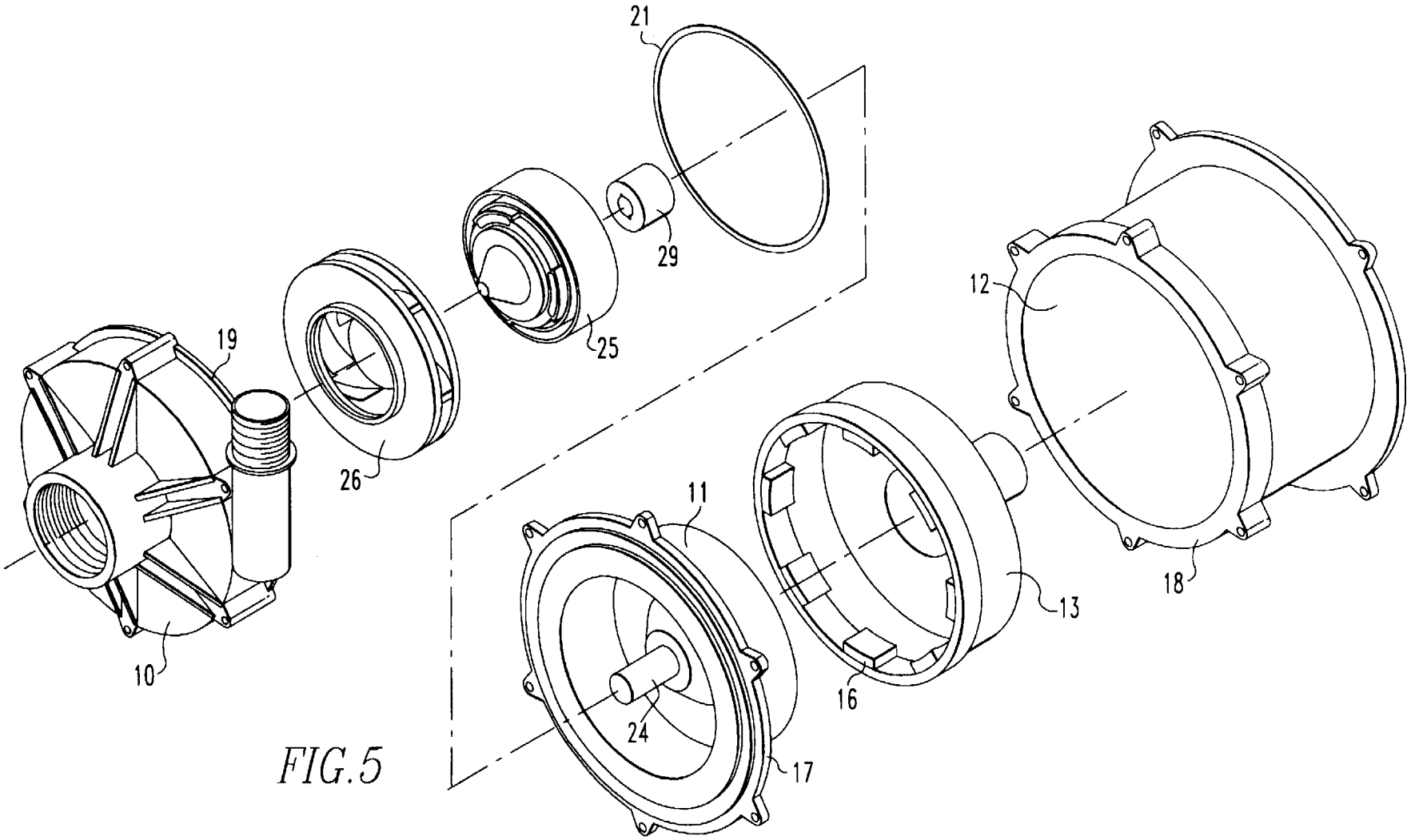
FIG. 5 is an exploded pictorial view of a pump having a magnetic drive according to this invention.

Referring now to FIGS. 1 and 5, there is illustrated in section a magnetically driven pump. A pump casing 10, nonmagnetic barrier 11 and standoff 12 are assembled together to define two chambers sealed from each other. The pump casing 10 and nonmagnetic barrier 11 define the impeller chamber and a chamber for accommodating a driven magnet assembly attached to the impeller. The standoff and nonmagnetic barrier define a chamber for a driving magnetic assembly. The standoff 12 is typically attached to a motor (not shown).

A driving magnet assembly 13 is positioned within the standoff 12 and is secured to the drive shaft 14 of the motor. The body of the driving magnet assembly has an inverted (as shown in the drawing) cup shape with a ferromagnetic (for example, steel) ring 15 around the rim. Secured to the inside of the ring are a plurality of permanent magnets 16 of the rare earth type.

The nonmagnetic barrier has radial flanges 17 which are captured between a radial flange 18 on the standoff 12 and a radial flange 19 on the pump casing. The three radial flanges are clamped by bolts (not shown) passing through holes provided in the flanges 17 and 19 and engaging threads 20 provided in flange 18. An O-ring 21 squeezed between the flanges seals the impeller chamber.

The nonmagnetic barrier has an inverted cup portion 22 which nests inside of the driving magnet assembly. The inverted cup has a cylindrical wall 23 with an axis that substantially coincides with the axis of the shaft 14. A cylindrical pin 24 is fixed to the nonmagnetic barrier. The axis of the pin 24 also substantially coincides with the axis of the motor shaft 14.

A driven magnet assembly 25 has a bushing 29 journaled on the pin 24. Attached to the front of the driven magnet assembly is the impeller 26. The driven magnet assembly 25 has a ferromagnetic ring 27 mounted therein. Secured on the outer cylindrical face of the ring 27 are a plurality of permanent magnets 28 of the rare earth type. The ring 27 and magnets 28 are encapsulated in a nonmagnetic resin to protect them from attack by corrosive liquids in the impeller chamber. The driven magnet assembly 25 slides axially along the pin 24 as well as rotates on the pin. The inner and outer magnetic ring assemblies can be transposed without affecting the function or embodiments of this invention. The magnets in the driven magnet assembly are positioned so that with a slight axial movement of the assembly, they can align with the magnets in the driving magnet assembly. No thrust bearings are required as the attraction between the two sets of rare earth magnets will hold the axial position of the driven magnet assembly and impeller.

Figure 2A:
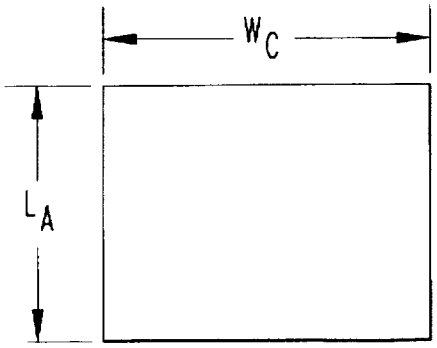
FIG. 2A is a top view of magnets according to this invention.
Figure 2B:
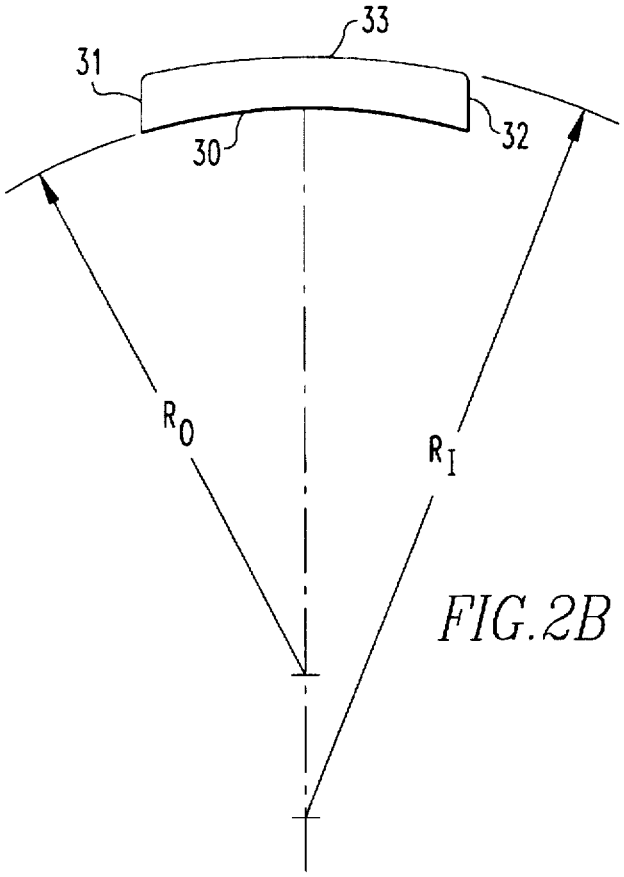
FIG. 2B is a side view of magnets according to this invention.

The ferromagnetic ring 15 in the driving magnet assembly 13 has an inner cylindrical surface having a radius of curvature $R_I$. The ferromagnetic ring 27 in the driven magnet assembly has an outer cylindrical wall having a radius of curvature $R_O$. Referring now to FIG. 2, the permanent magnets 16, 28 all have an identical shape and size. The magnets have two cylindrical faces, an outer face having a radius $R_I$ to match the inner cylindrical surface of the ring 15 in the driving magnet assembly and an inner face having a radius of curvature $R_O$ to match the outer cylindrical surface of the ring 27 in the driven magnet assembly. Preferably, the center of curvature of both cylindrical surfaces lies on the same line extending through an axial line bisecting the circumferential width of the inner face 30 and outer face 33 of the magnets. The axial length $L_A$ of the magnet faces and the circumferential width $W_C$ of the inner magnet face 30 are in a ratio from about $L_A/W_C$=1.5:1 to $L_A/W_C$=1:1.5.

The thickness of the magnets in the radial direction varies. The magnets are thickest near the circumferential end walls 31 and 32. Preferably, the edge of the circumferential end walls are rounded. This minimizes chipping and, in the case of the edges along the outer face 33, reduces the possibility that the encapsulating coating on the driven magnet assembly will be cut by the edges and come apart from the assembly exposing the magnets.

As should now be apparent, the inner face 30 of the magnets can lie flush against the ring 27 and the outer face 33 of the magnets can lie flush against the ring 15. This has been achieved by permitting the gap between the magnets on the ring 27 and the magnets on the ring 15 to be variable.

While the shape and size of all magnets are identical, the magnets are made in two sets, one magnetized north pole toward the radius of curvature of the faces (inward) and the other set magnetized north pole away from the radius of curvature of the faces (outward). Each ring has an even number of magnets equally spaced around the circumference thereof with magnets having opposite polarity alternating. The magnets may be installed using a jig that establishes the correct spacing. The magnetic attraction holds the magnets temporarily in place until an adhesive permanently secures the magnets to the rings.

Figure 3A:
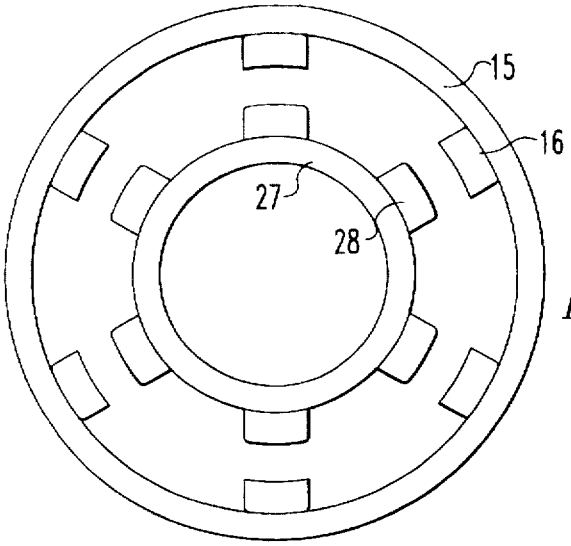
FIGS. 3A, 3B and 3C are schematic drawings of ferromagnetic rings and magnets according to this invention illustrating how one size and shape of magnet can be used to construct magnetic drives having different maximum torque transfer capabilities.
Figure 3B:
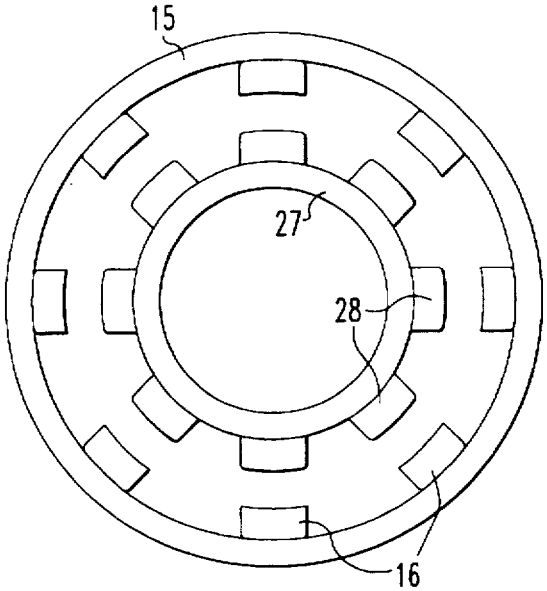
Figure 3C:
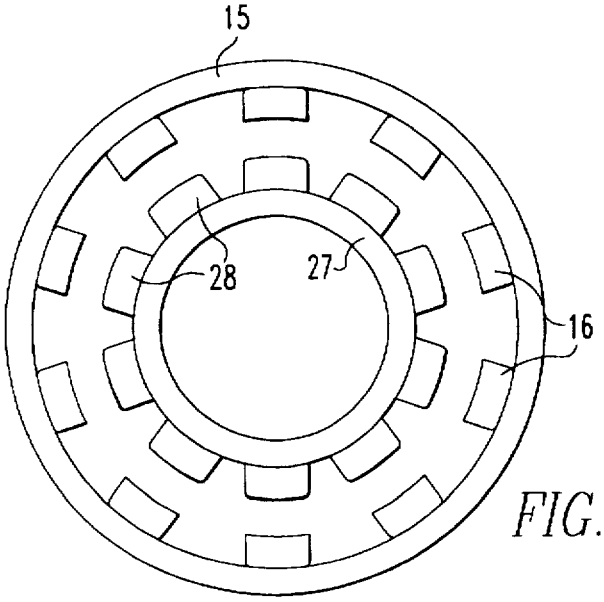

One of the advantages of the magnetic coupling described above is the torque transfer capability can be increased or decreased with no need to increase the number of different parts. Referring now to FIGS. 3A, 3B and 3C, there is shown the arrangement of the rings 15 and 27 and the magnets 16, 28 for three different maximum torque levels. In FIG. 3A, six pairs of magnets are arranged around the rings, in FIG. 3B eight pairs and in FIG. 3C ten pairs. The same identically sized and shaped magnets are used in all three arrangements. Going from the arrangement shown in FIG. 3A to that shown in FIG. 3B, maximum torque is increased about 35% and going from the arrangement 3B to the arrangement of FIG. 3C, the maximum torque is increased about 25%. These changes are possible without the need to make magnets of different sizes.

Figure 4:
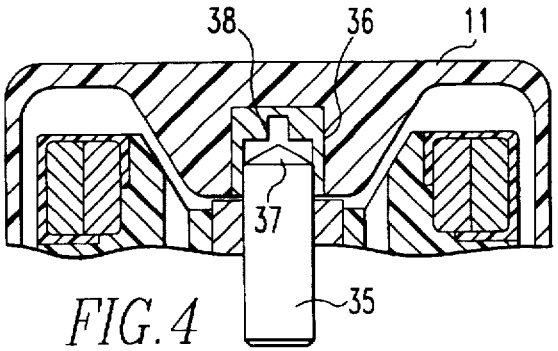
FIG. 4 is a section similar to that shown in FIG. 1 wherein the driven magnetic assembly is fixed to a shaft that is axially slidable in a bushing.

FIG. 4 illustrates an embodiment of this invention similar to that illustrated and described with reference to FIG. 1 except that the driven magnet assembly is fixed to the pin 35 and the pin 35 slides axially in a bushing 36 mounted in the nonmagnetic barrier 11. The end 37 of the pin 35 may have a cone shape. The bushing 36 may have a reduced radius section 38 that the apex of the cone-shaped end of the pin can enter. If the axial forces on the driven magnetic assembly overcome the axial restraining forces of the magnets, the cone-shaped end will contact the bushing along a ring of contact minimizing the heat that would be generated due to friction.

The driving and driven magnet assemblies preferably are molded from a strong and tough plastic. In this way, the assemblies channel the magnetic flux through the magnets, the ferromagnetic rings and the gap between the aligned magnets. The magnetic barrier should be strong and tough plastic, brass or nonmagnetic stainless steel, for example.

Having thus described our invention with the detail and particularity required by the Patent Laws, what is desired protected by Letters Patent is set forth in the following claims.

We claim:

1. A magnetic drive comprising a plurality of permanent magnets for transmitting torque to a shaft through a nonmagnetic cylindrical barrier comprising:

a first assembly positioned to rotate outwardly of the cylindrical barrier, said assembly having a first ferromagnetic ring with an inner radius RI;

a second assembly positioned to rotate inwardly of the cylindrical barrier, said assembly having a second ferromagnetic ring with an outer radius RO;

the first and second assemblies having an identical number of circumferential positions for receiving permanent magnets, said plurality of permanent magnets bonded at said circumferential positions;

all said magnets, whether bonded on the first or the second assembly, being identically sized and shaped;

said magnets having inner and outer cylindrical surfaces, the outer cylindrical surface having a radius substantially the same radius as the inner radius RI of the first ferromagnetic ring and the inner cylindrical surface having a radius substantially the same as the outer radius RO of the second ferromagnetic ring.

2. The magnetic drive according to claim 1, having axial dimensions and circumferential dimensions and wherein the axial and circumferential dimensions of the cylindrical faces of the identically shaped rare earth permanent magnets are substantially equal.

3. The magnetic drive according to claim 1, wherein the identically shaped magnets are radially magnetized.

4. The magnetic drive according to claim 1, wherein said first assembly comprises means for driving the first ferromagnetic ring.

5. The magnetic drive according to claim 1, wherein the magnets are comprised of the rare earth type magnets, for example, of the samarium cobalt and the neodymium iron boron type magnets.

6. The magnetic drive according to claim 1, wherein an even number of magnets are spaced around the circumference of the inner and outer cylindrical surfaces of said rings and the magnets are alternately radially magnetized toward and away from the cylindrical axis.

7. A magnetically driven pump comprising an impeller chamber, an impeller positioned to rotate in said chamber, a magnetic drive comprising a nonmagnetic cylindrical barrier, a first ring positioned to rotate outwardly of a cylindrical barrier, said first ring having an inner radius RI, a second ring positioned to rotate inwardly of the cylindrical barrier, said second ring having an outer radius RO, the first and second rings having an identical number of circumferential positions for receiving permanent magnets, a plurality of permanent magnets bonded at said circumferential positions, all said magnets whether bonded on the first or the second assembly being identically sized and shaped, said magnets having inner and outer cylindrical surfaces, the outer cylindrical surface having a radius substantially the same as the inner radius RI of the first ring and the inner cylindrical surface having a radius substantially the same as the outer radius RO of the second ring, means for connecting the first ring to a drive, and means for connecting the second ring to the impeller.

8. A method of making a series of magnetic drives with different maximum torque capacities from parts having identical dimensions comprising the steps for assembling a plurality of identically sized and shaped permanent magnets, a nonmagnetic cylindrical barrier, a first ring positioned to rotate outwardly of the cylindrical barrier, said first ring having an inner radius RI, a second ring positioned to rotate inwardly of the cylindrical barrier, said second ring having an outer radius RO, the first and second rings having an identical number of circumferential positions for receiving permanent magnets, said plurality of identically sized and shaped permanent magnets bonded at said circumferential positions, said magnets having inner and outer cylindrical surfaces, the outer cylindrical surface having a radius substantially the same as the inner radius RI of the first ring and the inner cylindrical surface having a radius substantially the same as the outer radius RO of the second ring, such that the only difference between magnetic drives of different maximum torque capacities is the number of pairs of permanent magnets spaced around the inner and outer rings.

* * * * *